US006117378A

United States Patent [19]

Eibl et al.

[11] Patent Number: 6,117,378

[45] Date of Patent: Sep. 12, 2000

[54] PROCESS FOR PRODUCING CELLULOSE FIBRES

[75] Inventors: Markus Eibl; Dieter Eichinger, both of Vöcklabruck, Austria

[73] Assignee: Lenzing Aktiengesellschaft, Lenzing, Austria

[21] Appl. No.: 08/849,464

[22] PCT Filed: Oct. 8, 1996

[86] PCT No.: PCT/AT96/00188

§ 371 Date: Aug. 22, 1997

§ 102(e) Date: Aug. 22, 1997

[87] PCT Pub. No.: WO97/14829

PCT Pub. Date: Apr. 24, 1997

[30] Foreign Application Priority Data

Oct. 13, 1995 [AT] Austria ..... A 1703/95

[51] Int. Cl.[7] ..... D01D 5/12

[52] U.S. Cl. ..... 264/210.8; 264/210.1; 264/290.5; 264/187; 264/203

[58] Field of Search ..... 264/203, 101, 264/187, 210.1, 210.7, 210.8, 211.12, 211.196, 288.4, 290.5

[56] References Cited

U.S. PATENT DOCUMENTS

| | | | |
|---|---|---|---|
| 3,447,939 | 6/1969 | Johnson et al. | 106/135 |
| 3,447,956 | 6/1969 | Johnson et al. | 117/154 |
| 3,982,325 | 9/1976 | Sigl et al. | 34/9 |
| 4,416,698 | 11/1983 | McCorsley III | 106/163 |
| 4,583,984 | 4/1986 | Turunen et al. | 8/125 |
| 4,682,983 | 7/1987 | Mehl | 8/468 |
| 5,094,690 | 3/1992 | Zikeli et al. | 106/198 |
| 5,409,532 | 4/1998 | Astegger et al. | 106/163 |
| 5,520,869 | 5/1996 | Taylor | 264/203 |
| 5,580,356 | 12/1996 | Taylor | 8/116.1 |
| 5,601,767 | 2/1997 | Firgo et al. | 264/101 |
| 5,698,151 | 12/1997 | Zikeli et al. | 264/187 |
| 5,709,716 | 1/1998 | Taylor | 8/40.1 |
| 5,725,821 | 3/1998 | Gannor et al. | 266/203 |
| 5,779,737 | 7/1998 | Potter et al. | 8/194 |
| 5,882,356 | 3/1999 | Potter | 8/116.1 |

FOREIGN PATENT DOCUMENTS

| | | |
|---|---|---|
| 0574870 | 6/1993 | European Pat. Off. . |
| 868042 | 2/1953 | Germany . |
| 4308524 | 9/1994 | Germany . |
| 9427903 | 12/1994 | WIPO . |
| 9428220 | 12/1994 | WIPO . |

OTHER PUBLICATIONS

Declaration of Dieter Eichinger and attached Exhibits A–H.

*Primary Examiner*—Merrick Dixon
*Attorney, Agent, or Firm*—Baker Botts LLP

[57] ABSTRACT

A process for the production of cellulose fibers, comprising the following steps:

(A) dissolving a cellulose-containing material in an aqueous, tertiary amine-oxide to obtain a spinnable cellulose solution;

(B) spinning said cellulose solution and passing it through an aqueous precipitation bath, whereby water-containing, swollen filaments are obtained;

(C) squeezing said water-containing, swollen filaments at various points, so that at least two squeezing points per millimeter of filament length on average are achieved and (D) drying said squeezed filaments to cellulose fibers, wherein squeezing is carried out using a pressure big enough so that said squeezing points produced on the filament are preserved also on the dried fibre and may be seen as color variations when observed under linearly polarized light.

5 Claims, No Drawings

PROCESS FOR PRODUCING CELLULOSE FIBRES

The invention is concerned with a process for the production of cellulose fibers according to the amine-oxide process, as well as with cellulose fibers, in particular cellulose staple fibers.

BACKGROUND OF THE INVENTION

For some decades there has been a search for processes for the production of cellulose moulded bodies as a substitute for the viscose process, which is widely employed. An alternative which is interesting for its reduced environmental impact among other reasons, is to dissolve cellulose without derivatisation in an organic solvent and extrude from this solution moulded bodies such as fibers, films and membranes. Fibres thus extruded have been accorded by BISFA (The International Bureau for the Standardization of man made fibers) the generic name Lyocell. By an organic solvent, BISFA means a mixture of an organic chemical and water.

It has turned out that as an organic solvent, a mixture of a tertiary amine-oxide and water is particularly appropriate for the production of cellulose moulded bodies. As the amine-oxide, primarily N-methylmorpholine-N-oxide (NMMO) is used. Other amine-oxides are described e.g. in EP-A- 0 553 070. A process for the production of mouldable cellulose solutions is known e.g. from EP-A- 0 356 419. The production of cellulose moulded bodies using tertiary amine-oxides generally is referred to as amine-oxide process.

U.S. Pat. No. 4,246,221 describes an amine-oxide process for the production of cellulose solutions which are spun into filaments in a forming tool such as a spinneret and afterwards passed through a precipitation bath, wherein the cellulose is precipitated and water-containing, swollen filaments are obtained. These filaments may be processed to cellulose fibers and staple fibers in the conventional way, i.e. by washing and post-treatment. It is known that the cellulose fibers produced from amineoxide solutions according to the dry/wet spinning process have, in contrast to natural, crimped cellulose fibers such as cotton, an unlobed, round cross-section. When they are processed to yarns and plane fibre assemblies, the round cross-section and the relatively smooth surface may cause problems, as described e.g. in EP-A- 0 574 870. According to this patent application, these problems include a deficient adhesion of the fibers to each other when the spinning fibre is spun to yarns, an insufficient cover of the filament yarns and insufficient slippage resistance of the plane fibre assemblies produced from this fibre and filament yarns. To solve these problems, the above patent application proposes to extrude the amine-oxide solution through spinning holes having a cross-section which is not circular but shaped, for example Y-shaped. Thus, the Lyocell fibers get a Y-shaped section.

In Chemical Fibers International (CFI), volume 45, February 1995, pages 27 and 30, the microscopic illustration of four cellulose fibers all produced according to the amine-oxide process is shown. It is interesting that these fibers are not identical, although all of them are produced according to the amine-oxide process. The differences between the four fibers can be seen even under the microscope. In the literature cited it is not indicated how those skilled in the art may produce the different cellulose fibers, in other words no information is given to those skilled in the art how it is possible to make each of the fibers look different.

In Textilia Europe 6/94, pages 6ff, also a cellulose fibre produced according to the amine-oxide process is described, and again those skilled in the art are not given any clues about the details of the production. Based on other information, it can be gathered from this literature that the cellulose fibre, the production of which is not indicated, has a permanent crimp, but no more detailed information given as to what is meant by this and how the fibre may be crimped.

Crimped fibers are advantageous various reasons for, particularly for processing them into staple fibers. For instance, it is easier to card the fibers, since a certain adhesion of the fibers among each other is required to produce a card sliver. A crimped fibre has a higher sliver adhesion than a non-crimped fibre, and thus it is possible to increase the carding rate.

In the prior art, so-called crimp processes whereby fibers may be crimped are known. However, a crimping thus achieved is mostly lost after carding and even moreso after spinning to yarns, and is not found any more in the textile fabric. Crimping if present, would give a bulky, soft feel to the textile fabric.

From WO 94/28220 and WO 94/27903, a process whereby Lyocell fibers may be crimped in a mechanical way is known. According to this process, the freshly produced, tow-shaped filaments first are passed through a number of washing baths to remove the solvent. Then the tow is dried at approximately 165° C. and introduced in a dry state into a pipe-shaped device, wherein the filament tow is creased and thus some kind of crimping is achieved. Additionally, the crimped fibre is treated with hot, dry vapour and afterwards cut to a staple fibre. These fibers have the drawback that their production requires a complex arrangement, since a separate device for crimping is required, and that crimping is achieved by creasing the fibers. Moreover, it has been shown that crimping carried out in a mechanical way according to that known process is lost again for the fibre after some further post-processing steps.

It is the object of the invention to provide a process for the production of a new Lyocell fibre which may be processed to yarns and fabrics in an easier way than the conventional Lyocell fibre. The new fibre is not to be produced by means of mechanical crimping according to WO 94/28220 or WO 94/27903. Neither is the fibre to be produced using spinnerets exhibiting spinning holes which have a noncircular cross-section. Rather, the Lyocell fibre produced according to the invention is to be produced using conventional spinnerets having spinning holes which exhibit a circular cross-section.

SUMMARY OF THE INVENTION

The process according to the invention for the production of a cellulose fibre comprises the following steps:

(A) dissolving a cellulose-containing material in an aqueous, tertiary amine-oxide to obtain a spinnable cellulose solution;

(B) spinning the cellulose solution and passing it through an aqueous precipitation bath, whereby water-containing, swollen filaments are obtained;

(C) squeezing the water-containing, swollen filaments at various points, so that at least two squeezing points per millimeter of filament length on average are achieved and (D) drying the squeezed filaments to cellulose fibers, wherein squeezing is carried out with a pressure high enough so that the squeezing points produced on the filament are preserved also on the dried fibre and may be seen as color variations when observed under linearly polarized light.

For the purposes of the present specification and claims, the term "squeezing points" refers also to flexures, twists and other changes of the cross-section shape of the filaments and fibers.

The invention is based on the finding that a filament produced according to the amine-oxide process may be changed in its cross-section shape in a swollen state by means of squeezing, and that the squeezing points are preserved after drying when the pressure used for squeezing is high enough. Thus cellulose fibers having a cross-section shape which is not circular but for instance ovally deformed at the squeezing points may be produced. The squeezing points may be observed under the microscope also as dents, widenings or flexures.

Naturally, the extent of pressure to be exerted when squeezing depends on several parameters, such as the fibre titre, the degree of swelling and the extent of the cross-section changes desired. The inventors of the present invention have found out that the pressure necessary to achieve the desired cross-section changes may be determined by previous testing in a simple way.

Squeezing the fibre may be achieved by passing the swollen filaments through an appropriate forming tool such as a plate press, the surface of said plate press being structured by prominences and depressions to expose the swollen filaments in longitudinal direction to pressures of different extents and thus deform the filaments to different degrees.

The swollen filaments also may be squeezed by passing the filaments across a roll and exerting the pressure necessary for squeezing the filaments using a mating roll having an appropriately structured surface.

Moreover it is possible to combine the swollen filaments to a tow consisting of thousands of filaments, twist it in longitudinal direction and pass it in that state through a pair of rolls exerting the pressure necessary for squeezing.

Squeezing is preferably carried out such that at least three, particularly at least six squeezing points per millimeter of filament length are achieved.

It has been shown that the fibers produced according to the invention may be carded more easily, since the squeezing points evidently give the fibers a certain adhesion among each other, so that it is easier to produce a card sliver. The fibers produced according to the invention have a higher sliver adhesion among each other than a conventional Lyocell fibre having a circular cross-section over its entire length. This makes it possible to increase the carding rate.

A preferred embodiment of the process according to the invention is characterized in that the water-containing, swollen filaments obtained above in step (B) are cut before pressing.

A further preferred embodiment of the process according to the invention is characterized in that a fleece wherein the cut filaments have a random orientation is produced from the cut, water-containing, swollen filaments before squeezing, and that said fleece is pressed. It has been shown that in this case the pressing surface does not necessarily have to be structured, since the pressures of different extents required to produce an irregular surface are achieved by the fact that the fibers lie on top of each other due to their random orientation, and thus evidently during pressing a higher pressure is exerted at those points where the fibers lie on top of each other than at other points. This implies a different deformation of the cross-section.

In this embodiment of the process according to the invention it is possible to carry out pressing along with the usual squeezing out of washing water from a staple fibre fleece, as is known from the viscose process. Usually, dewatering is carried out by one or more pairs of rolls wherethrough the staple fibre fleece is passed on a travelling screen. It is decisive however that the pair(s) of rolls exert a sufficiently high pressure on the fleece so as not only to reduce the water content but also to change the cross-section shape of the cut, swollen filaments to a sufficient extent.

The invention is also concerned with a cellulose fibre, particularly a cellulose staple fibre, which may be produced according to the process according to the invention. The fibre according to the invention is characterized in that the change achieved in the cross-section of the fibre is preserved, i.e. that it does not disappear after carding or after producing yarn. This facilitates the further processing of the Lyocell fibre according to the invention.

Moreover, it has been shown surprisingly that the fibre strength and the fibre elongation of the fibers produced according to the amine-oxide process are not deteriorated by the change of the cross-section.

The invention is further concerned with yarns, fabrics, nonwovens and knit fabrics, characterized in that they contain the fibers according to the invention.

DETAILED DESCRIPTION OF THE INVENTION

By means of the following Example, the invention is explained in more detail.

EXAMPLE 1

First, a spinnable solution of cellulose in water-containing NMMO was produced using the process described in EP-A-0 356 419.

This spinnable solution was spun into filaments according to the process described in WO 93/19230 using a spinneret having circular spinning holes. After drawing in an air gap, the filaments were passed into an aqueous precipitation bath wherein the cellulose coagulated. The water-containing filaments obtained, present in a swollen state and hydroplastic, were cut to staple lengths of 4 cms.

The cut filaments were slurred in water in a mixer and the cut filaments whirled up in the water were applied to a travelling screen whereon a fleece of the cut fibers was formed, the fibers showing random orientation. The travelling screen was passed through a pair of rolls exerting a pressure of approximately $10_6$ Pa on the fleece for a time of about 0,1 seconds. Thereafter the fleece was washed and passed through a further pair of rolls again exerting a pressure of approximately $10^6$ Pa on the fleece. Afterwards, the staple fibers obtained were dried.

An analysis of the fibers according to the invention under the polarization microscope (magnification×400) showed that on average 7 squeezing points per millimeter of fibre length, whereat a change of color of polarized light could be observed, were achieved. At the squeezing points, the fibers exhibited a cross-section which was not circular but more or less irregularly deformed. The change of color of the irradiated light is due to the different thickness of the fibers at each of the squeezing points.

Yarns were produced from the fibers obtained, and the adhesion lengths of the slivers were measured according to DIN 53834, Part 1. The fibers produced according to the invention showed a comparatively higher sliver adhesion length than fibers not produced according to the invention having a substantially circular cross-section.

What is claimed:

1. A process for the production of cellulose fibers comprising:

dissolving a cellulose-containing material in an aqueous, tertiary amine-oxide to obtain a spinnable cellulose solution;

spinning said cellulose solution into filaments and passing the filaments through an aqueous precipitation bath to obtain water-containing, swollen filaments;

squeezing said water-containing swollen filaments at an average of at least two squeezing points per millimeter of filament length on and drying said squeezed filaments to cellulose fibers, said squeezing being carried out by applying a pressure high enough to preserve said squeezing points on the dried fibre, said squeezing points being observable as color variations when said dried fibre is exposed to linearly polarized light.

2. A process according to claim 1, wherein squeezing is carried out such that at least three squeezing points per millimeter of filament length on average are achieved.

3. A process according to claim 1, wherein squeezing is carried out such that at least six squeezing points per millimeter of filament length on average are achieved.

4. A process for the production of cellulose fibers according to any one of claims 1 to 3, wherein said water-containing, swollen filaments are cut before squeezing.

5. A cellulose fibre produced by the process of any one of claims 1 to 3.

* * * * *

UNITED STATES PATENT AND TRADEMARK OFFICE

CERTIFICATE OF CORRECTION

PATENT NO. : 6,117,378
DATED : September 12, 2000
INVENTOR(S) : Eibi et al.

It is certified that error appears in the above-identified patent and that said Letters Patent is hereby corrected as shown below:

Claims,
Column 5,
Line 12, "length on and" should read -- length; and --

Column 6,
Line 1, "fibre," should read -- fiber, --
Line 2, "fibre" should read -- fiber --
Line 13, "fibre" should read -- fiber --

Column 1,
Line 2, "FIBRES" should read -- FIBERS --
Line 12, "which is widely" should read -- which is today widely --
Line 40, "amineoxide" should read -- amine-oxide --

Column 2,
Line 10, "various reasons for," should read -- for various reasons, --
Line 19, "moreso" should read -- more so --
Line 20, "any more" should be deleted
Line 24, nonwovens" should read -- non-wovens --

Column 4,
Line 41, "cms." should read -- cm. --
Line 45, "The" should read -- The --
Line 47, "$10_6$" should read -- $10^6$ --
Line 48, "0,1 seconds." should read -- 0.1 second. --

Signed and Sealed this

Thirteenth Day of November, 2001

*Attest:*

Nicholas P. Godici

NICHOLAS P. GODICI
*Acting Director of the United States Patent and Trademark Office*

*Attesting Officer*